United States Patent [19]

Rocereta

[11] 4,216,871

[45] Aug. 12, 1980

[54] CAR UNCOUPLERS FOR MODEL TRAIN TRACKS

[76] Inventor: William J. Rocereta, 402 Butterfield Dr., North Hungtingdon Township, Westmoreland County, Pa. 15642

[21] Appl. No.: 922,832

[22] Filed: Jul. 10, 1978

[51] Int. Cl.[2] ..... B61G 7/04

[52] U.S. Cl. ..... 213/211; 46/1 K; 104/DIG. 1; 213/75 TC

[58] Field of Search ..... 104/147 A, DIG. 1; 213/75 TC, 211, 212; 238/10 R, 10 A, 10 B, 10 C, 10 E; 46/1 K, 216, 217, 218

[56] References Cited

U.S. PATENT DOCUMENTS

| | | | |
|---|---|---|---|
| 2,157,187 | 5/1939 | Rexford | 213/211 X |
| 2,240,137 | 4/1941 | Gilbert et al. | 213/211 X |
| 2,305,134 | 12/1942 | Case et al. | 213/211 X |
| 2,318,741 | 5/1943 | Bowen et al. | 213/211 |
| 2,617,541 | 11/1952 | Goode | 213/211 |
| 2,998,145 | 8/1961 | Maurer, Sr. | 213/212 |
| 3,056,512 | 10/1962 | Zion | 213/211 |
| 3,942,648 | 3/1976 | Edwards et al. | 213/212 X |

FOREIGN PATENT DOCUMENTS

| | | | |
|---|---|---|---|
| 543072 | 7/1957 | Canada | 213/211 |

*Primary Examiner*—Randolph A. Reese
*Attorney, Agent, or Firm*—Wm. Henry Venable

[57] ABSTRACT

This invention relates to a device for uncoupling the cars of model trains travelling on tracks assembled on conventional cork roadbeds. The uncoupler disclosed and claimed operates from a normal, inactivated position in which no parts extend between the track rails, to an activated state in which a pair of wings rotate to fold towards one another between the track rails and engage the depending fingers of car couplers between cars indexed at the car uncoupling position.

8 Claims, 8 Drawing Figures

CAR UNCOUPLERS FOR MODEL TRAIN TRACKS

SUMMARY OF THE INVENTION

The main object of this invention is to provide a car uncoupling device for conventional model train car couplers which has no component extending upwardly between the track rails during the normal passage of model trains across the uncoupling station. When the operator wishes to uncouple the locomotive from the cars, or to uncouple one or more cars, with this invention he stops the train with the coupler to be released indexed directly above an uncoupling device below the track and then activates the device to engage the fingers of the coupler above and rotate the coupler arms to disengage the following car from the preceding locomotive or car. The locomotive is then energized to move forward and leave the uncoupled car stationary, for loading, unloading, or whatever other operation the model train set-up provides at that track section. To remove the uncoupled car, the uncoupling device is inactivated to disengage the finger of the coupler on the stationary car, leaving no component extending upwardly between the rails, and a locomotive or train section is backed against the stationary car and coupled thereto in the conventional manner.

Another object of this invention is to provide a pair of articles of manufacture for uncoupling cars as described above, for marketing at hobby shops or other retail establishments which trade in model trains. These are a special track section to be mounted on sections of conventional cork roadbed used in model train track construction, and a special uncoupling structure devised to fit between the cork roadbed sections. The track section and uncoupling structure are constructed to interlock together in assembly, thus indexing them in operative position on assembly.

To provide free passage of trains over the track section with nothing extending upwardly between the rails, the uncoupling structure between the cork roadbed sections is provided with a pair of rotatable wings which, in inactivated position, extend horizontally below the rails from pivot axes adjacent the track center line. Means are provided to rotate said wings towards a vertical position between the track rails for engagement of the fingers of car couplers located above the uncoupling structure as mentioned above.

DETAILED DESCRIPTION

Figure 2:
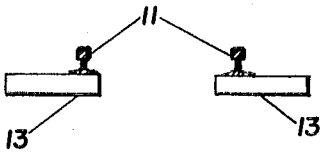
FIG. 2 is a transverse section through the track section at the plane II—II in FIG. 1.
Figure 1:
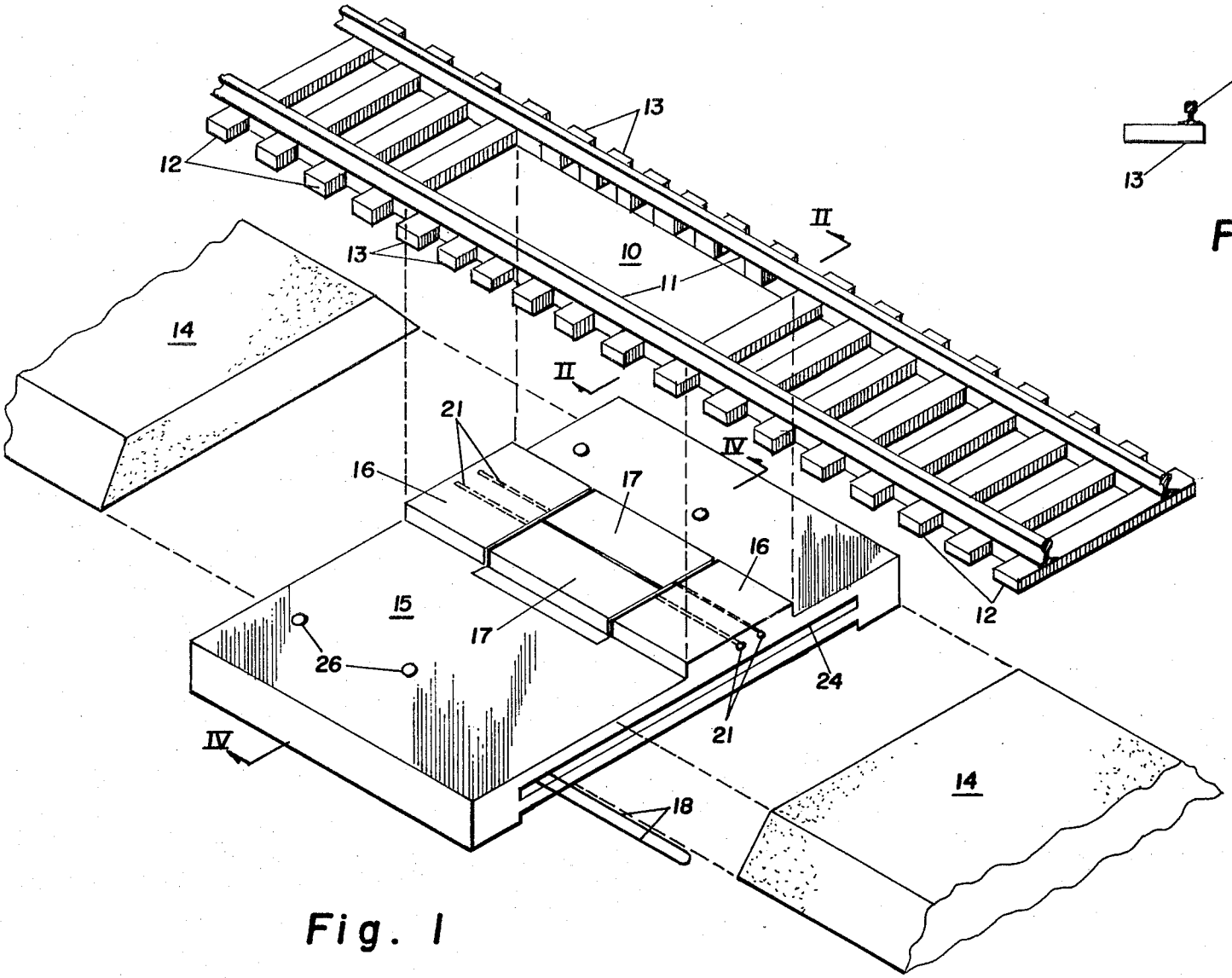
FIG. 1 is an exploded isometric view of one embodiment of the invention, illustrating the track section and the uncoupler structure assembly in the inactivated state for travel of model trains over the track.

Referring to FIG. 1, a track section 10 having rails 11 has full length ties 12 only on the end portions thereof, which, in assembly, rest upon conventional cork roadbed strips 14. The roadbed strips 14 are spaced apart a distance fitting against the opposite sides of a car-uncoupler base component 15. The intermediate portion of the track 10 assembled against the base 15 has a clear, open space between the rails 11, on the sides of which as seen in FIGS. 1 and 2, are end pieces 13 of ties, extending laterally from the rails 11 a short distance on each side. The car-uncoupler base component 15 has a top surface flush with the top of the cork roadbed strips 14, except for raised ledges 16 which, in assembly, fit between the adjacent tie end pieces 13 and, at their ends, fit against the portion between the rails of the adjacent ties 12 which are at the opposite ends of the open intermediate portion of the track 10, thereby indexing the track 10 and the car-uncoupler base 15 in assembly of the structure.

As is conventional in model train track construction, it is understood that the cork roadbed strips 14 are, in turn, mounted upon a supporting board, not illustrated in FIG. 1, and that this supporting board is continuous under the uncoupler base 15 and provides a bottom support therefor.

Figure 3:
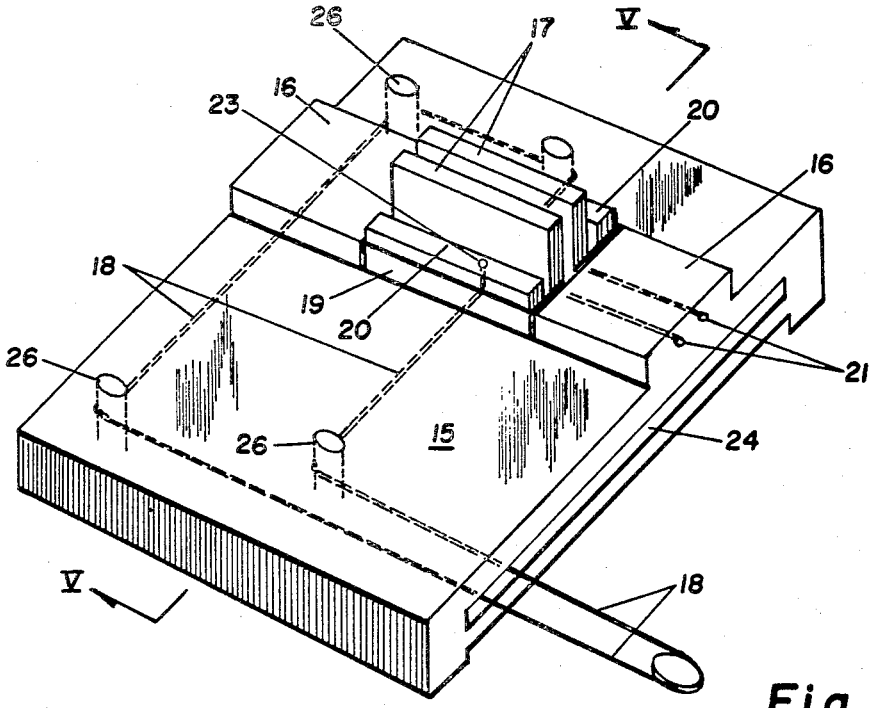
FIG. 3 is an isometric view of the car uncoupling structure in extreme activated state.
Figure 4:
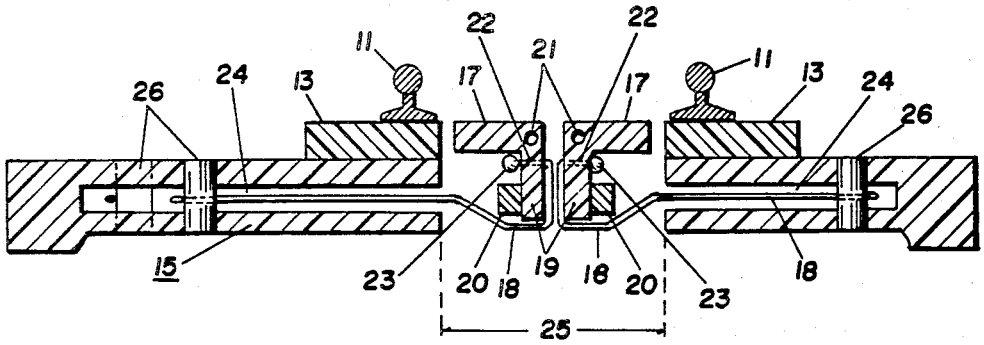
FIG. 4 is a vertical cross-section through the uncoupler structure at the plane IV—IV in FIG. 1.

Between the two ledges 16 and in the clear, open space 25 between the rails 11 of the track 10, one sees in FIGS. 1 and 4 a pair of car-uncoupling wings 17 as they appear in the inactivated, normal state for passage of trains across the track section 10. When activated, these wings 17 rotate about pivots adjacent to the center line of the track, towards the extreme, substantially vertical, position illustrated in FIGS. 3 and 5. The outer edges of these wings which are adjacent any tie pieces 13 in inactivated position are slightly spaced therefrom, to avoid rubbing friction on rotation of the wings 17, and any tie end pieces 13 in this zone serve merely a decorative function. The above mentioned upward rotation of the wings 17 is effected by pulling a string loop 18, extending from within the base 15 as shown in FIG. 1 and subsequently described.

Figure 5:
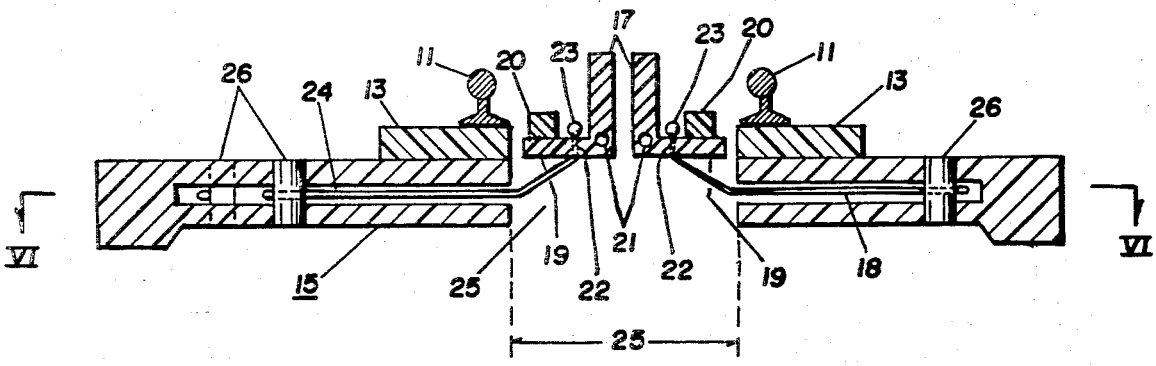
FIG. 5 is a vertical cross-section through the uncoupling structure taken at the plane V—V in FIG. 3.

As shown in FIGS. 3, 4 and 5, in this embodiment of my invention the wings 17 are flanges of angle-section elements which also have flanges 19 at right angles to the wings 17, on which are attached weights 20.

In this embodiment the wings 17 and flanges 19 are rotatably mounted between the raised ledges 16 about pivot pins 21, which, for convenience in assembly, are shown as pins driven through holes in the ledges 17 to extend a short distance into holes on opposite ends of the wings 17, at the apex of junction of wings 17 and flanges 19. The pivot pins 21 are spaced apart a short distance across the center line of the track 10, this spacing allowing some clearance between the flanges 19 in inactivated, dependent position. Preferably the edge of the wings 17 adjacent the pivot axis is rounded slightly to insure free rotation.

Figure 6:
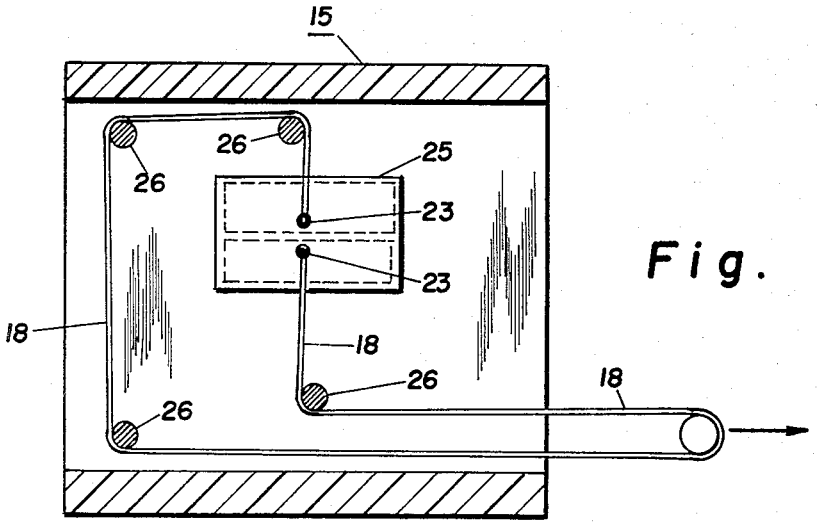
FIG. 6 is a horizontal cross-section through the uncoupler structure taken at the plane VI—VI in FIG. 5.

Through the flanges 19, just below the pivot axis and preferably at the midpoint lengthwise, a small hole 22 is drilled, through which the ends of the string loop 18 are threaded and a knot 23 is tied to anchor the string ends at that point. From these terminae, the string extends around the flanges 19 on each side and thence laterally towards the sides of the slot 24, whence the string 18 is guided around guide pins 26 driven through the base 15 across the slot 24 at the positions illustrated in FIGS. 1, 3 and 6, to the pull extension of the loop from the uncoupler as illustrated in FIGS. 1 and 3.

It is apparent from the foregoing description and the illustrations referred to that when the string loop 18 is slack, the weights 20 bias the flanges 19 to remain in the substantially vertical position through the opening 25 illustrated in FIG. 4, the uncoupling wings lying horizontal with their top surfaces substantially level with the top of the ledges 16. When, however, tension is applied to the string loop 18, the ends of which, in FIG. 4, are wrapped around the flanges 19, the string deflection rotates the flanges 19 towards substantial horizontal position shown in FIGS. 3 and 5, and thereby rotates the wings 17 towards one another. If, at that time, the train is indexed on the track with couplers between the locomotive and a car or a pair of cars, such that the coupler fingers depend between the wings 17, rotation of the wings 17 pinches the coupler fingers together and unlatches the coupler, so that forward motion of the locomotive or forward car releases the car behind, which remains stationary. The operator then releases pull on the loop 18, and the weights 19 reverse the rotation of the wings 17 to return to normal, inactivated, position shown in FIG. 1.

Figure 7:
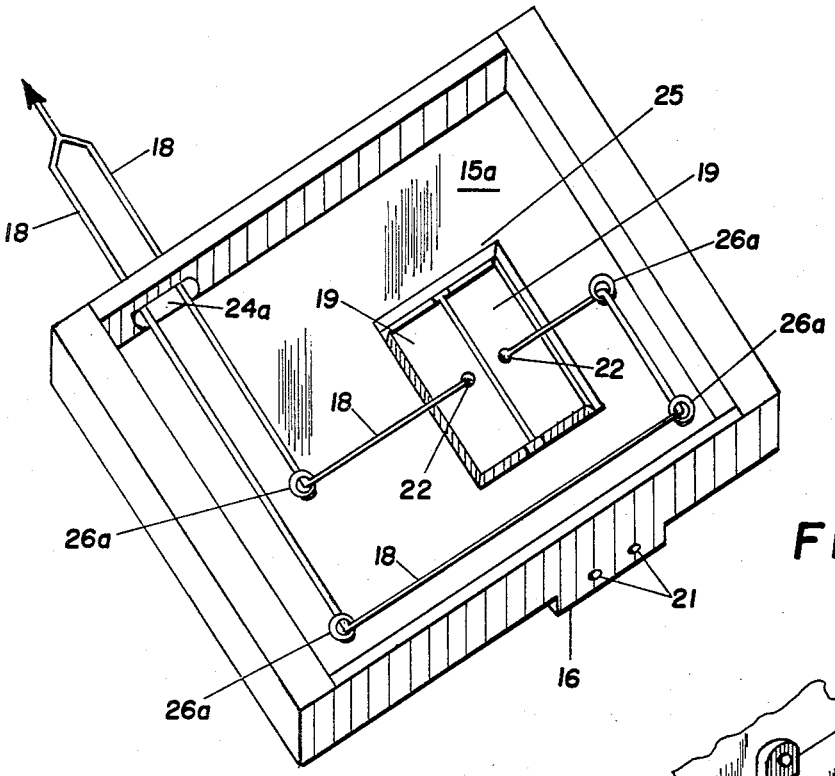
FIG. 7 is an isometric view of an alternate construction of the uncoupler structure in inverted position.

In the uncoupler assembly embodiment illustrated in FIG. 7, the base component 15*a*, instead of having a transverse slot 24 and guide pins 26 therethrough, is illustrated as being an open bottom rectangular box on which a set of metal eyes 26*a* are screwed into the top slab at substantially the same positions as the guide pins 26 in base component 15. The string loop 18 is threaded through these eyes 26*a*, and passes to the outside of the base component 15*a* through a short slot 24*a* through the bordering wall of 15*a* on one side thereof. The raised ledges 16 are formed on the top of the base component 15*a* on opposite sides of the rectangular opening 25 and the wings 17 with flanges 19 are rotatably mounted thereon as previously described.

Figure 8:
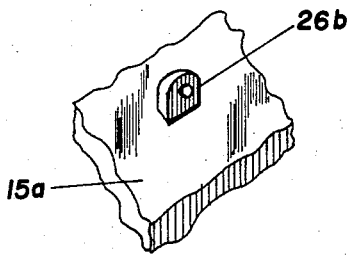
FIG. 8 illustrates an optional modification of one detail of the alternate seen in FIG. 7.

As an alternate to metal eyes screwed into the base 15*a*, eyes 26*b* may be molded directly on 15*a* as illustrated in FIG. 8, these being located in the same positions as the metal eyes 26*a* shown in FIG. 7.

This invention is not limited to track construction mounted on cork roadbeds, as in the example specifically described and illustrated. It comprehends any roadbed construction including for example, a flat surfaced table on which the car coupler release component 15 would also be assembled. In such case, the track section 10 could rest on spacers of the same thickness as component 15 extending above the table surface, and inclined track pieces could be provided between the ends of the track 10 and the sections connected thereto.

Also, the term "string" as used above comprehends any truly flexible and knotable material which does not appreciably stretch under tension.

I claim:

1. A car uncoupling device for model train tracks assembled on conventional cork roadbeds comprised, in combination, of a track section and a car-coupler release component; said track section being mounted above said car-coupler release component in interlocking relation thereto and extending beyond opposite sides of said car-coupler release component for attachment in assembly to cork roadbed sections; said track section including ties between the track rails only on the extensions thereof for attachment to said cork roadbed sections; a base member of said car-coupler release component of substantially the same depth as the cork roadbed and adapted to abut against the ends of sections thereof to which said track section is attached in assembly; raised ledges on opposite sides of an opening through said base member between the rails of said track section, said ledges abutting against the adjacent ties of said track section to position and lock said car-coupler release component and said track section in assembly; a pair of wings between said raised ledges rotatably mounted on pivots parallel to and adjacent to the center line of said track section; means operable from outside said car-coupler release component for rotating said wings upwardly towards one another to deflect the uncoupling fingers of conventional car couplers indexed above said car-coupler release component, and flanges attached to said wings for rotating said wings by gravity to rest at a level below said rails, said flanges extending at right angles to said wings from the axes of said pivots.

2. The combination set forth in claim 1 in which weights are mounted on said flanges to assist downward rotation of said wings by gravity.

3. The combination set forth in claim 2 in which said means operable from outside said car-coupler release component for rotating said wings upwardly is comprised of a string, the ends of which are anchored to said flanges adjacent to said pivot axes; said string being threaded between and around said flanges and about guides in said base member to extend outside said car-coupler release component, whereby pulling the extension at said string simultaneously rotates both wings upwardly towards one another.

4. The combination set forth in claim 3 in which said base member is slotted horizontally below said ledges and said guides are pins vertically provided through said horizontally slotted component; said string being threaded around said pins and through the horizontal slot.

5. The combination set forth in claim 3 in which said base member is formed, below said ledges, substantially as an open-bottom box and said guides are eyes mounted therein through which said string is threaded.

6. An article of manufacture for use in model train track assemblies to optionally uncouple cars of model trains, comprised of a base member adapted for insertion between roadbed sections below the track; a pair of car uncoupling wings rotatably mounted in said base member on axes adjacently parallel to the track centerline, said wings in inoperative position extending horizontally from said axes below said track; a rectangular opening through said base member of length slightly greater than that of said wings and of width substantially the same as the distance between the track rails; flanges attached to said wings at right angles thereto adjacent said parallel axes, said flanges adapted to initiate pivoting of said wings to inoperative position by gravity; said flanges in inoperative position extending downwardly through said rectangular opening; and means for rotating said wings upwardly between the rails of said track towards one another thereby to deflect the uncoupling fingers of couplers indexed above said wings.

7. An article of manufacture as set forth in claim 6 in which said means for rotating said wings is comprised of a string extending from outside said base member and threaded internally therein to attachment to said wings about said flanges at right angles to said wings.

8. An article of manufacture as set forth in claim 7 in which said flanges are provided with counterweights balancing the pull of said string to reverse the rotation of said wings when the string pull terminates, whereby said wings return to normal inactivated position.

* * * * *